United States Patent [19]

Linkletter

[11] 4,087,319

[45] May 2, 1978

[54] METHOD OF AND MEANS FOR SHEET TRANSFER TO AND EMBOSSING AT A REELING STATION

[75] Inventor: Merle G. Linkletter, Beloit, Wis.

[73] Assignee: Beloit Corporation, Beloit, Wis.

[21] Appl. No.: 754,369

[22] Filed: Dec. 27, 1976

[51] Int. Cl.[2] ..... B31C 11/02

[52] U.S. Cl. ..... 162/113; 162/122; 162/193; 162/255; 162/281; 162/283; 162/362; 242/65

[58] Field of Search ..... 162/111, 113, 118, 120, 162/122, 193, 204, 255, 280, 281, 283, 362; 264/283; 156/183; 242/65

[56] References Cited

U.S. PATENT DOCUMENTS

| | | | |
|---|---|---|---|
| 1,842,889 | 1/1932 | Williams | 162/283 |
| 1,894,253 | 1/1933 | McCarthy et al. | 242/65 |
| 3,096,233 | 7/1963 | Rappaport et al. | 162/255 X |
| 3,203,850 | 8/1965 | McCarty | 162/113 |
| 3,355,349 | 11/1967 | Devlin | 162/193 X |
| 3,846,228 | 11/1974 | Ely et al. | 162/111 X |

*Primary Examiner*—Richard V. Fisher
*Attorney, Agent, or Firm*—Hill, Gross, Simpson, Van Santen, Steadman, Chiara & Simpson

[57] ABSTRACT

A continuously advancing tissue paper web is separated from a Yankee dryer roll and creper, and then received and transported on an endless fabric conveyor and embossing belt travelling toward and over a reel drum. At the reeling station the web is threaded onto a reel spool and wound into a parent roll pressing against the conveyor and embossing belt running over the reel drum and thereby embossing the web in the roll/drum nip. Means are provided for automatically air threading the web onto the reel spool. For higher bulk tissue creped sheet, additional dry embossing may be effected while the sheet is being transported by the conveyor belt.

33 Claims, 2 Drawing Figures

METHOD OF AND MEANS FOR SHEET TRANSFER TO AND EMBOSSING AT A REELING STATION

Figure 1:
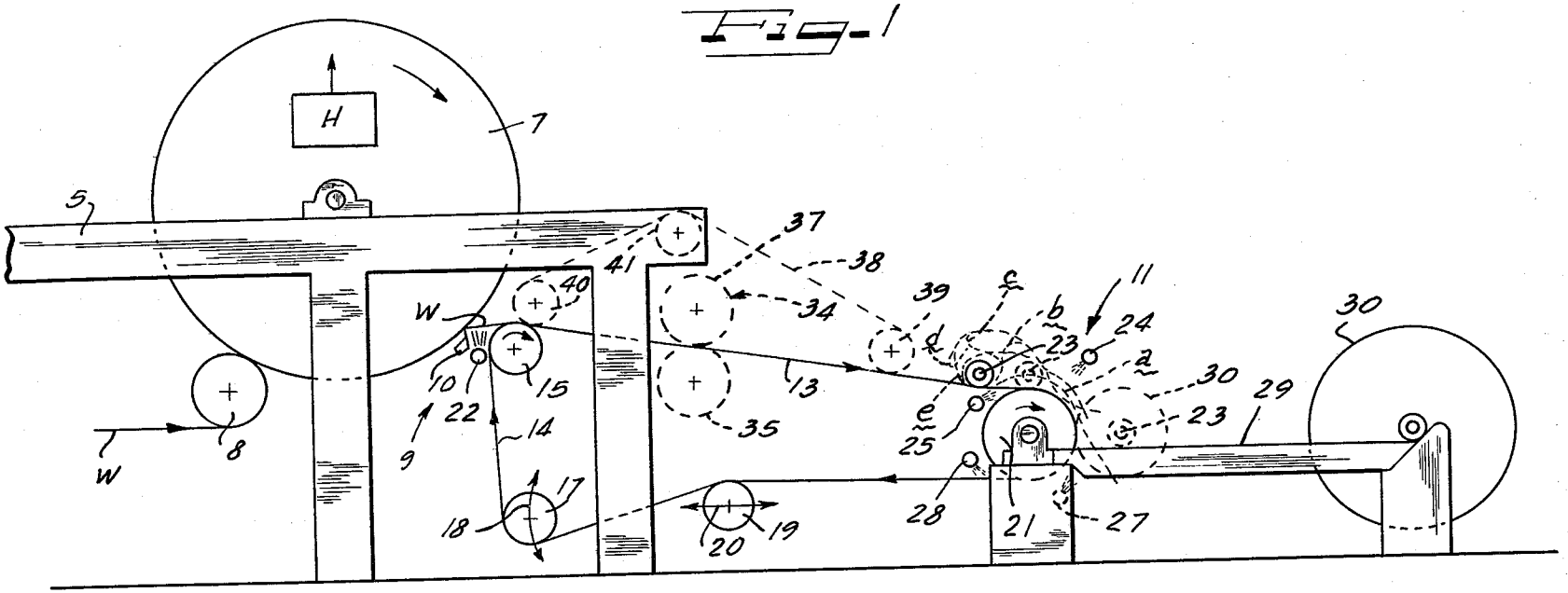

This invention relates to a new and improved method of and means for sheet transfer and embossing, and is more particularly concerned with the handling and treatment of creped paper sheet web between creping on a Yankee dryer and reeling of the web.

Heretofore the web of creped paper sheet from a Yankee creping doctor has been transferred to the wind-up reel largely unsupported except possibly for one or more small diameter paper carrying rollers and sometimes a single nip calender. Such handling of the web has been satisfactory on machines where reel speeds have been below about 3500 fpm. However, for increased reel speeds approaching 4500 to 7000 fpm or higher, the lightweight creped tissue sheet web becomes increasingly hard to handle in the necessary length of transfer distance from the Yankee dryer to the reel. Furthermore, some tissue manufacturers in order to supply increasing consumer demand for high bulk, lightweight tissue sheets require dry embossing to create higher bulk, and this has heretofore necessitated additional embossing equipment.

According to prior practice, threading of the web onto the reel spool has presented a problem.

An important object of the present invention is to provide a new and improved method of and means for sheet transfer and embossing which will overcome the disadvantages, drawbacks, inefficiencies, shortcomings and problems inherent in prior practice.

Another object of the invention is to provide a new and improved method of and means for transferring and threading creped sheet web from dryer and creping means to a reel spool.

Another object of the invention is to provide a new and improved method of and means for embossing a creped sheet web as it is being wound into a parent roll.

Still another object of the invention is to provide a new and improved method of and means for automatically threading a creped sheet web onto a reel spool.

Still another object of the invention is to provide a new and improved method of and means for effecting multiple embossments of a creped sheet web continuously advancing between a creper and a reeling station.

According to features of the invention, there is provided a method of and means for sheet transfer and embossing wherein a tissue paper web is continuously advanced from creping means, and received on a supporting run of an endless fabric conveyor belt on which the web is transported toward a reel drum over which the belt runs. The continuously advancing web is then threaded onto and continuously wound into a parent roll on a reel spool adjacent to the reel drum. The winding parent roll is pressed against the reel drum and the fabric conveyor belt running over the reel drum, thereby embossing the web in the drum/roll nip.

According to other features of the invention, a method of and apparatus are provided for transporting a creped tissue paper web and automatically threading it onto reeling means.

According to additional features of the invention, a method of and means are provided for dry embossing a creped tissue web at a reeling station, and also optionally upstream from the reeling station.

Figure 2:
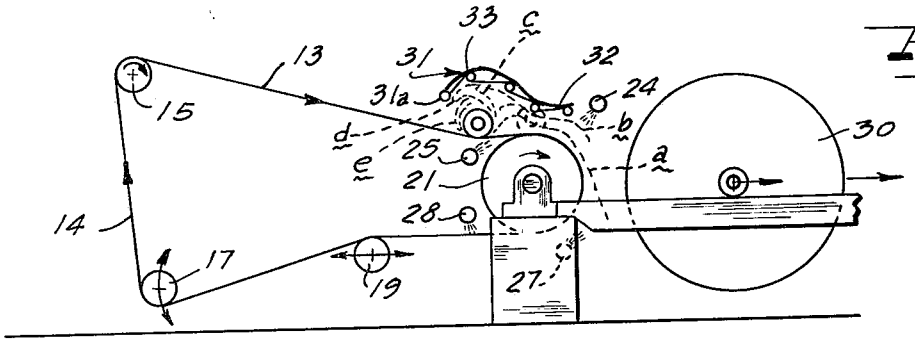

Other objects, features and advantages of the invention will be readily apparent from the following description of representative embodiments thereof, taken in conjunction with the accompanying drawing although variations and modifications may be effected without departing from the spirit and scope of the novel concepts embodied in the disclosure, and in which:

FIG. 1 is a schematic elevational view of the creping, transfer and reeling section of a creped tissue paper making machine; and FIG. 2 is a similar schematic elevational view showing a modification.

On reference to the drawings, a papermaking machine frame 5 supports means for drying and creping a tissue paper sheet web W, such means desirably comprising a rotatably driven Yankee dryer roll 7 which, as is usual, is a relatively large metal roll that is provided with a smooth (mirror), finish for receiving and dewatering the web W thereon and is also generally provided with means for heating the interior thereof (indicated diagrammatically at H) in order to accelerate the dewatering of the web moving on the travelling Yankee dryer surface. The largely dewatered web W is directed onto the lower portion of the Yankee dryer 7 by means of a pasting roll 8 which may, if desired, be a suction roll. From the pasting nip between the Yankee dryer 7 and the roll 8, the web travels on the preferably heated surface of the Yankee dryer 7 to a creping device 9 which comprises one or a plurality of creping doctors 10 from which the web W leaves the Yankee dryer 7 and heads toward a reeling station 11.

After passing the creping station 9, the leading end of the web W is separated and deflected from the Yankee roll 7 by means of the creping doctor 10 and received on a supporting run 13 of an endless fabric conveyor and embossing belt 14 which continuously supports and transports the web W to the reeling station 11. The fabric conveyor belt 14 is of full machine width so that it fully supports the entire width of the web W. Optionally the fabric of the endless conveyor belt 14 may or may not be woven in a continuous loop. If it is not a continuous loop, a pin type seam may join the ends. By preference the fabric mesh may be in the range of 10 to 80 mesh, and of at least sufficient porosity to permit air to be blown through the belt.

As closely adjacent as practicable to the creping doctor 10, the receiving end of the transporting run 13 of the conveyor belt 14 starts over a lead-in roll 15, to which the return run of the belt 14 travels from a stretch roll 17. This roll 17 may be adjustably mounted as indicated by the arrow 18 for tensioning the belt, in addition to or independently of a roll 19 for guiding the belt and which may also be adjustable as indicated by the directional arrow 20. At the reeling station 11, the fabric conveyor belt 14 is trained to run over a reel roll or drum 21 which is desirably suitably driven by power means, not shown, to drive the conveyor belt 14.

As the leading end of the web W leaves the Yankee dryer roll 7, it is guided across the narrow gap between the roll 7 and the receiving end of the transporting run 13 of the conveyor belt 14 by means of an air threading shower projected from an orificed manifold 22 located adjacently below the gap. This prevents the leading end of the web from dipping down through the gap, and assures its being propelled onto the continuously travelling conveyor belt 14 as it runs up over the lead-in roll 15 into the transporting run 13. It will be understood that the speed of travel of the conveyor belt 14 will be coordinated with the peripheral speed of rotation of the Yankee dryer drum 7 so that the web W will be efficiently transported to the reeling station 11. Such transporting efficiency is enhanced by inclination of the transporting run 13 generally downwardly from the lead-in roll 15 to the reeling drum 21.

When the advancing end of the web W as transported on the carrying run 13 of the conveyor belt 14 reaches the reeling station 11, it travels under a reeling core or spool 23 which presses down into the conveyor belt sufficiently to maintain good traction. The web W then normally travels on with the conveyor belt and partially around the reel drum 21. As the leading end of the web reaches the reel drum 21, downward curving of the web around the reel drum is assisted by means of an air shower delivered from a manifold 24 located in spaced relation generally above the right side of the reel drum 21 as viewed in FIG. 1. Automatic threading of the web onto the reel spool 23 is initiated after the leading end of the web has travelled with the belt a short distance such as about 90° around the reel drum 21, by upward billowing of that portion of the web advancing past the reel spool 23 by means of an air shower directed from a device such as a manifold 25 located below the fabric conveyor belt and forcing the air upwardly through the conveyor belt in the area between the reel spool 23 in the threading position and the reel drum 21. Thereby the advancing end portion of the web is lifted as shown at *a*. Since the area of the conveyor belt through which the lifting or billowing air shower is directed is spaced upstream from the area where the air shower from the manifold 24 pushes the web toward the reel drum 21, the advancing extremity of the web is frictionally restrained against upward movement under the influence of the lifting air shower from the manifold 25 so that the web continues to billow upwardly to a position generally indicated at *b* higher than the shower manifold 24. To assure that the leading end of the web W does not continue to adhere to the conveyor belt and defeat the automatic air threading of the web onto the reel spool 23, a web dislodging safety air shower is directed by means such as an air shower manifold 27, generally upwardly from below the reel drum 21 toward the leading end of the web to dislodge it from the belt and loosen the advancing end portion of the web to facilitate the billowing action of the air shower from the manifold 25. As a safety precaution against possible adherence of the leading end of the web to the conveyor belt with such tenancity as to escape the air shower from the manifold 27, a positive dislodging air shower is projected by means of a shower manifold 28 located above the return run of the conveyor belt immediately after it leaves the reel drum 21, such air shower projecting through the fabric of the belt and blowing the advancing end of the web downwardly and away from the belt and generally toward the air shower device 27.

Upon attaining the air shower thrust billow *b*, the air shower directed from the shower device 24 thrusting laterally generally toward the reel spool 23, deflects the buckled web toward position *c* where it overlies the reel spool 23. Under the continuing force of the air showers from the devices 24 and 25, the web continues to buckle and deflect to generally position *d* and the envelope that has thus developed extends over and beyond the reel spool to the point where it folds down and collapses onto the on running side of the reel spool as indicated at position *e* and is drawn into the nip of the reel spool and the belt run 13, whereupon the web end portion winds onto the reel spool. Upon completion of the automatic air threading as thus effected, the reel spool is moved by suitable cam or other means (not shown) into the dash line position over the top of and into contact with the reel drum 21 through the web being wound on the reel spool and the conveyor belt and then is continuously held in engagement with the reel drum as the reel spool is lowered to secondary rails 29. Then as winding of the web continues onto the reel spool and a parent roll 30 develops, continuous thrust of the parent roll toward and against the fabric belt running over the reel drum 21 effects continuous dry embossing of the web throughout the parent roll winding. Winding of the parent roll 30 and continuous dry embossing of the web continues until the roll approaches full weight diameter. In the meantime another one of the reel spools 23 is placed in the initial or threading position on the supporting run 13 of the conveyor belt adjacently upstream from the reel drum 21. Upon the parent roll 30 reaching the desired size, it is shifted on the rails 29 away from the reel drum 21 substantially as shown in FIG. 2, the automatic air threading system which during the parent roll winding may have been shut-off is reactivated. Thereby a new air threading cycle is initiated before or after severing the leading end portion of the web. The same automatic air threading sequence as already described is then followed. The full parent roll is moved to the discharge end of the rails 29 as shown in FIG. 1, making room for the next succeeding parent roll to be wound as a continuous process.

If preferred, the automatic air reel spool threading may be assisted by a curved, pivoted sheet tucker 31 (FIG. 2) which generally overlies the threading position of the reel spool 23 and the reel drum 21 in the reeling station 11. In a preferred form, as shown, the sheet tucker 31 is of generally ogee shape having a generally downwardly bowed lead-in section 32 adjacent to the air shower device 24 and acting to hold the billowing web in the position *b* depressed adjacent to the shower device 24 to facilitate action of the shower device in driving the billowing tuck of the web more rapidly into the succeeding positions *c, d* and *e* assisted by a downwardly concave web directing portion 33 of the tucker. The guidance provided by the tucker 31 eliminates any possibility of the air motivated threading leading portion of the web from escaping or deflecting away from the reel spool during the threading operation. Upward deflection of the tucker about a pivot 31*a* permits shifting movements of the reel spool 23.

It will be understood, of course, that all of the air shower devices 22, 24, 25, 27 and 28 may be supplied from individual or common compressed air source, that each of the devices may have the air pressure thereat and therefrom regulated to suit the particular location and function of the particular air shower device. Further, any suitable sequential operation control may be employed using known electromechanical and pneumatic control devices for the purpose. No specific means for severing the web from the parent roll on completion of winding of the parent roll has been shown because such means are well known in the art.

If additional dry embossing of the creped tissue sheet to obtain higher bulk is desired, an embossing press 34 may be mounted to act on the web W while it is transported along the supporting run 13 of the conveyor belt at an intermediate position between the creping doctor 10 and reeling station 11. Such an additional embossing press may comprise a hard cover roll 35 running in engagement with the underside of the belt run 13 while a soft rubber-like upper roll 37 presses the belt and the tissue web carried thereby against the roll 35.

If for any reason it is deemed desirable, a second fabric endless belt 38 may be guided to run on top of the sheet web W carried by the supporting run 13 of the conveyor belt 14. Suitable rolls 39, 40 and 41 may be installed for guiding the opposite ends of the belt 38 adjacent to but spaced from respectively the reeling station 11 and the creping doctor 10. Where the auxiliary belt 38 is employed, it will be understood that the embossing press 34 may or may not be employed, as preferred. If the embossing press 34 is employed, the embossing action of the upper embossing roll 37 will be through the belt 38 toward the web intervening between the conveyor belt run 13 and the belt 38 and the nip of the rolls 35 and 37.

From the foreging it will be apparent that the present invention provides for high speed operation wherein the web W may be produced at speeds of up to 7000 fpm. Not only is drying and creping of the tissue sheet provided for, but high speed operation is facilitated and enhanced by substantially full support of the creped web from the creper to the reeling station, automatic air threading is provided for, and dry embossing is achieved to the extent desired in a simple and efficient manner.

It will be understood that variations and modifications may be effected without departing from the spirit and scope of the novel concepts of this invention.

I claim as my invention:

1. A method of sheet transfer and embossing, comprising:

continuously advancing a tissue paper web from creping means;

receiving the continuously advancing web on a supporting run of an endless fabric conveyor belt starting closely adjacent to the creping means;

advancing the web on the conveyor belt toward a reel drum over which the belt runs;

threading the continuously advancing leading end portion of the web onto a reel spool adjacent to said reel drum;

continuously winding the threaded web into a parent roll on the reel spool;

pressing the parent roll, as it is being wound, against the fabric conveyor belt running over said reel drum;

and in the nip of the parent roll and the reel drum embossing the continuously advancing web.

2. A method according to claim 1, comprising generating an air shower under a leading end of the web in a gap between the creping means and the conveyor belt and thereby transferring the leading end across the gap to the conveyor belt.

3. A method according to claim 1, comprising thrusting the reel spool against the fabric conveyor belt adjacently in advance of said reel drum, and threading the web onto the reel spool while the reel spool is pressed against the conveyor belt.

4. A method according to claim 3, comprising directing air against the leading end portion of the web and thereby effecting said threading of the web onto the reel spool.

5. A method according to claim 4, comprising driving air through the fabric conveyor belt and thereby lifting the leading end portion of the web from the belt, and directing air against the lifted leading end portion of the web and thereby driving the leading end portion into threading engagement with the reel spool rotating in engagement with the belt.

6. A method according to claim 1, comprising driving air through the fabric conveyor belt adjacent to said reel spool and thereby dislodging the advancing end portion of the web from the conveyor belt in the vicinity of the reel drum for effecting said threading.

7. A method according to claim 1, comprising additionally embossing the continuously advancing web on said conveyor belt in advance of said reel drum.

8. A method according to claim 1, comprising lifting the leading end portion of the web from the fabric conveyor belt by impinging air onto the leading end portion through the conveyor belt to effect said threading, and then guiding the lifted leading end portion into threaded engagement with the reel spool.

9. A method of transferring a continuously advancing tissue paper web from creping means to a reeling station, comprising:

separating the web from the creping means;

continuously transporting the web on a conveyor and embossing belt to the reeling station;

winding the continuously advancing web into a parent roll at the reeling station;

and pressing said parent roll against the continuously advancing web supported on the conveyor belt and thereby embossing the web.

10. A method according to claim 9, comprising transporting a leading end portion of the web from the creping means across a gap between the creping means and the conveyor belt, by directing transporting air under the leading end portion in said gap.

11. A method according to claim 9, comprising effecting additional embossing at an intermediate position along said conveyor run between the creping means and the reeling station.

12. A method according to claim 9, comprising effecting said embossing in the nip of said parent roll and a reel drum continuously as the web is wound in the parent roll.

13. A method according to claim 9, comprising automatically air threading a leading end portion of the continuously advancing web onto a reel spool engaging said belt at said reeling station.

14. A method of embossing a creped continuously advancing tissue paper web, comprising:

transferring the continuously advancing the web from creping means to and over a reel drum on a conveyor and embossing belt running over the reel drum;

winding the web into a parent roll;

pressing the parent roll as it is being wound against the belt where the belt runs over the reel drum;

and embossing the continuously advancing web on the belt in the nip of the parent roll and the reel drum.

15. A method according to claim 14, comprising separating the parent roll from the reel drum when the parent roll has attained a desired size, severing the web from the parent roll, air threading the several leading end of the web onto a reel spool to start another parent roll, and pressing said another parent roll against the conveyor belt on the reel drum and into embossing relation to the web in the nip of said another parent roll and the reel drum.

16. Apparatus for sheet transfer and embossing, comprising:

means for continuously advancing a tissue paper sheet from creping means;

means for receiving the continuously advancing web comprising a supporting run of an endless fabric conveyor belt starting closely adjacent to the creping means;

a reel drum over which the belt runs and toward which the web is advanced on the conveyor belt supporting run;

a reel spool adjacent to said reel drum;

and means for threading the continuously advancing leading end portion of the web onto the reel spool;

said reel spool being operative for continuously winding the web into a parent roll on the reel spool in a position to press the parent roll as it is being wound against the fabric conveyor belt running over said reel drum whereby the nip of the parent roll and the reel drum will effect embossing of the continuously advancing web.

17. Apparatus according to claim 16, including means for generating an air shower under a leading end of the web in a gap between the creping means and the conveyor belt for thereby transferring the leading end across the gap to the conveyor belt.

18. Apparatus according to claim 16, wherein said reel spool thrusts against the fabric conveyor belt adjacently in advance of said reel drum, and means for threading the web onto the reel spool while the reel spool is pressed against the conveyor belt.

19. Apparatus according to claim 18, wherein said means for threading comprise a device for directing air against the leading end portion of the web.

20. Apparatus according to claim 19, wherein said device is located to drive air through the fabric conveyor belt and thereby lift the leading end portion of the web from the belt, and an additional device for directing air against the lifted leading end portion of the web and thereby driving the leading end portion into threading engagement with the reel spool rotating in engagement with the belt.

21. Apparatus according to claim 19, wherein said air directing device causes the leading end portion of the web to billow toward the reel drum, and a tucker operatively related to the reel spool and the air directing device for guiding the web end portion into threading relation to the reel spool.

22. Apparatus according to claim 16, wherein said threading means comprise a device for driving air through the fabric conveyor belt adjacent to said reel spool to dislodge the advancing end portion of the web from the conveyor belt in the vicinity of the reel drum for effecting the threading action of said threading means.

23. Apparatus according to claim 16, comprising means for additionally embossing the continuously advancing web on the conveyor belt in advance of said reel drum.

24. Apparatus according to claim 16, wherein said threading means comprise a device for impinging air onto the leading end portion of the web through the conveyor belt to effect lifting of the leading end portion of the web from the fabric conveyor belt, and means for guiding the lifted leading end portion into threaded engagement with the reel spool.

25. Apparatus according to claim 24, wherein said guiding means comprises a pivoted tucker overlying the reel spool and the reel drum.

26. Apparatus for transferring a continuously advancing tissue paper web from creping means to a reeling station, comprising:

means for separating the web from the creping means;

a conveyor and embossing belt for continuously transporting the web to the reeling station;

means for winding the continuously advancing web into a parent roll at the reeling station;

and means mounting said parent roll in position to press against the continuously advancing web supported on the belt for embossing the web.

27. Apparatus according to claim 26, including means for transporting the leading end portion of the web from the creping means across a gap between the creping means and the conveyor belt, said transporting means comprising a device for directing transporting air under the leading end portion of the web in said gap.

28. Apparatus according to claim 26, including additional web embossing means located at an intermediate position along said belt run between the creping means and the reeling station.

29. Apparatus according to claim 26, wherein said parent roll presses against a reel drum carrying the belt continuously as the web is wound in the parent roll.

30. Apparatus according to claim 26, including means for automatically air threading a leading end portion of the continuously advancing web onto a reel spool at said reeling station.

31. Apparatus according to claim 30, wherein said air threading means cause the leading end portion of the web to billow toward the reel spool, and tucker means cooperating with said air threading means and said reel spool for guiding said leading end portion onto the reel spool.

32. Apparatus for embossing a creped continuously advancing tissue paper web after leaving creping means, comprising:

a conveyor and embossing belt running over a reel drum and arranged for transferring the continuously advancing web from the creping means toward the reel drum;

and means for winding the web into a parent roll;

said winding means being cooperative with the reel drum for pressing the parent roll as it is being wound against the conveyor belt where the belt runs over the reel drum whereby to effect embossing of the continuously advancing web on the belt in the nip of the parent roll and the reel drum.

33. Apparatus according to claim 32, comprising means enabling separation of the parent drum from the reel drum when the parent roll has attained a desired size whereby to permit severing the web from the parent roll, and means for air threading the leading end of the web onto a reel spool to start another parent roll, said reel spool being adapted to press said another parent roll against the reel drum and into embossing relation to the web and the belt in the nip of said another parent roll and the reel drum.

* * * * *

UNITED STATES PATENT AND TRADEMARK OFFICE

CERTIFICATE OF CORRECTION

PATENT NO. : 4,087,319
DATED : May 2, 1978
INVENTOR(S) : Merle G. Linkletter

It is certified that error appears in the above-identified patent and that said Letters Patent are hereby corrected as shown below:

Column 6, line 63, change "several" to ---severed---.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*